US005377857A

United States Patent [19]

Taravella et al.

[11] Patent Number: 5,377,857

[45] Date of Patent: Jan. 3, 1995

[54] STACKABLE BIN WITH COLLAPSIBLE CORNER CONSTRUCTION

[75] Inventors: Philip Taravella, Grosse Pointe Shores; Edward J. Blair, New Baltimore; Ronald S. Domanski, St. Clair Shores; Joseph C. Shippell, Roseville, all of Mich.

[73] Assignee: Anchor Bay Packaging Corporation, St. Clair Shores, Mich.

[21] Appl. No.: 180,735

[22] Filed: Jan. 13, 1994

[51] Int. Cl.[6] ..... B65D 6/12

[52] U.S. Cl. ..... 220/4.33; 220/7; 206/512

[58] Field of Search ..... 220/4.33, 7, 512

[56] References Cited

U.S. PATENT DOCUMENTS 2,775,361 12/1956 Kasdan ..... 220/4.34

4,828,132 5/1989 Francis, Jr. et al. ..... 220/4.33

5,191,989 3/1993 Butler ..... 220/4.34

5,193,701 3/1993 Bush et al. ..... 220/4.33

*Primary Examiner*—Joseph Man-Fu Moy

*Attorney, Agent, or Firm*—Dykema Gossett

[57] ABSTRACT

A collapsible bin has corner constructions that provides reinforcement at the corners thereof and joins the walls of the bin in a box configuration that may be collapsed. The collapsible corner construction includes a pair of casements joined together by an anchor pin. The anchor pin is received in T-slots within each of the casements. The anchor pin may be slipped or removed from the T-slots to release the casements from their joined condition, so that the walls of the container may be collapsed. An interlocking tab and slot configuration provides interlocking means for stacking one collapsible bin upon another.

11 Claims, 3 Drawing Sheets

STACKABLE BIN WITH COLLAPSIBLE CORNER CONSTRUCTION

BACKGROUND OF THE INVENTION

1. Field of the Invention

The present invention relates to bins, cartons or containers that are collapsible and more particularly to corner constructions for each such container, the corner constructions being slidable off the container so that at least one wall of the container may be collapsed for access to the container's contents. Still more particularly, the present invention relates to corner constructions for collapsible containers so that said containers may be reusable after being collapsed. The present invention also relates to structures for collapsible containers that will allow the containers to be stackable and nestable with other such containers.

2. Statement of Problem

A shipping container or bin containing fruit, vegetables, goods, parts or other useable products is often accessed by collapsing a wall of the container or bin to make the contents available. Often the contents are directly displayed and dispensed from the container in this manner. One means of collapsing the wall of such a container or bin, particularly a fiberboard container or bin, is by using a mat knife or the like to cut the corners of the container to collapse the wall. Such a method, while gaining ready access to the contents, is wasteful in that the containers are not reusable after their corners are cut unless such cutting is precise and the sides are taped for reuse. In the latter instance, the taped corners are weakened corners. Consequently, containers with taped corners are usually not reusable. Moreover, as the containers are shipped, or stored, one on top of another, there is often a breakdown of the sides of the containers so that, if they may be used again, their useful life is often only one or two cycles.

SUMMARY OF THE INVENTION

1. Objects of the Invention

It is one object of the present invention to provide a means for collapsing bins or corrugated boxes, fiberboard, plastic or wood without the need for precise cutting of the edges of the boxes or containers.

It is another object of the present invention to provide a means for collapsing bins or containers so that they are reusable after being collapsed.

It is yet another object of the present invention to provide a means for stacking boxes without breaking down the boxes to diminish their useful life.

2. Disclosure of the Invention

The foregoing objects are accomplished by a shipping container or bin that has a knock down or collapsible corner construction which the Inventors have developed for collapsible containers. A shipping container or bin comprises a number of side walls that have different horizontal lengths. The bin, which also has a floor, has, as an example, eight walls. The container may consist of any number of walls as is well known in the art. When assembled into a box construction, the walls extend orthogonally to the plane of the floor and may be collapsed into the plane of the floor.

A collapsible corner construction in accordance with the present invention joins pairs of walls together. The corner construction or comer includes a pair of casements which may be positioned onto an edge of a wall. Each casement has an inboard lip extension which projects from the casement on one side thereof. Each casement also has a buttressing portion carrying a T-slot or other suitable configuration. The buttressing portion projects outwardly from the casement away from the edge of the wall. Accordingly, the casement and the buttressing portion operate as an extension of the edge of a wall.

The corner construction also has an angle section or anchor pin that has a generally triangular or other suitable cross-section. At two opposing corners thereof, as an example, are T-sections that are receivable in the T-slots of the casements from an upper end of the corner construction, the upper end being defined by the normal orientation of the bin in use with its side walls projecting orthogonally from the floor. Other suitable configurations may be used in place of the T-sections and T-slots.

Lip extensions provide structural rigidity against a back wall of an angle section or anchor pin. The angle section or anchor pin being positioned accordingly, the angle section may be slid up from the floor of the bin and down until it rests generally at floor. Two holes in the angle section provide a means of gripping the angle section by a hook, or screwdriver, or specially fashioned tool, to slide the angle section upwardly and outwardly from the casements. Assuming the wall is joined to a wall at its opposite edge by a collapsible corner and an angle section or anchor pin, if the latter is also removed, the wall is collapsible as it is no longer joined together with another wall. The wall is, however, joined to the floor of the bin, so that the wall hingedly swings into the plane of floor.

Stacking anchor tabs or tongues are preferably placed on upper edges of walls of bin to provide for a means of interlocking the bins when the bins are stacked one bin upon the other. Tabs, which are but extensions of the floor of the bin, are provided with slots for receiving the anchor tabs. Several bins may be stacked one upon the other, each anchored to the other by having each tab received by the tab slot of a bin stacked upon it.

Several embodiments of the hock down or collapsible corner or corner construction include a corner formed to provide a right angle or any angle relationship between adjoining casements to complete the container.

DETAILED DESCRIPTION OF THE INVENTION

Figure 1:
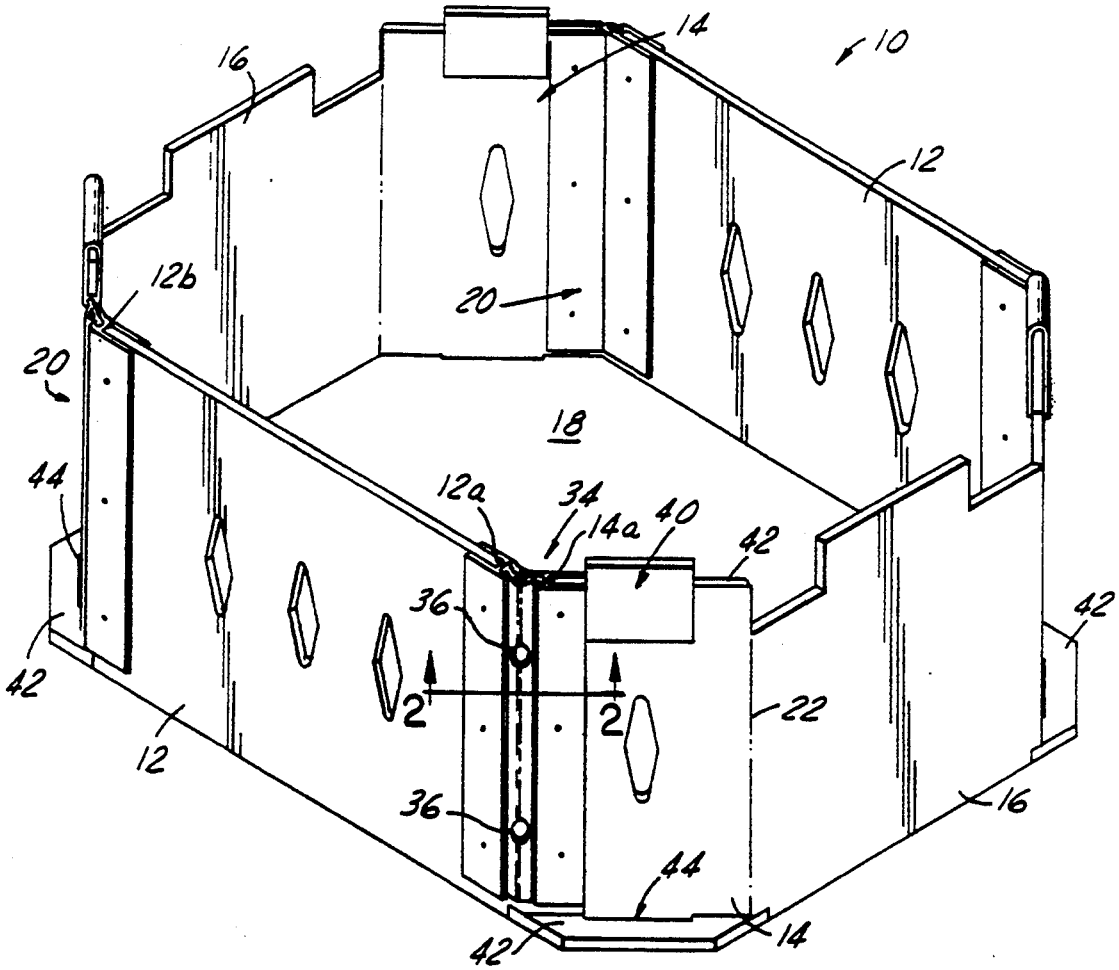
FIG. 1 is a perspective view of a shipping container utilizing the hock down comer construction in accordance with the present invention.

With reference to FIG. 1 of the drawings, a shipping container or bin 10 comprises a number of side walls 12, 14 and 16. Walls 12, 14, and 16 have different horizontal lengths. The bin 10 has eight walls in all although various numbers of walls may be used. The bin 10 also has a floor 18.

Figure 4:
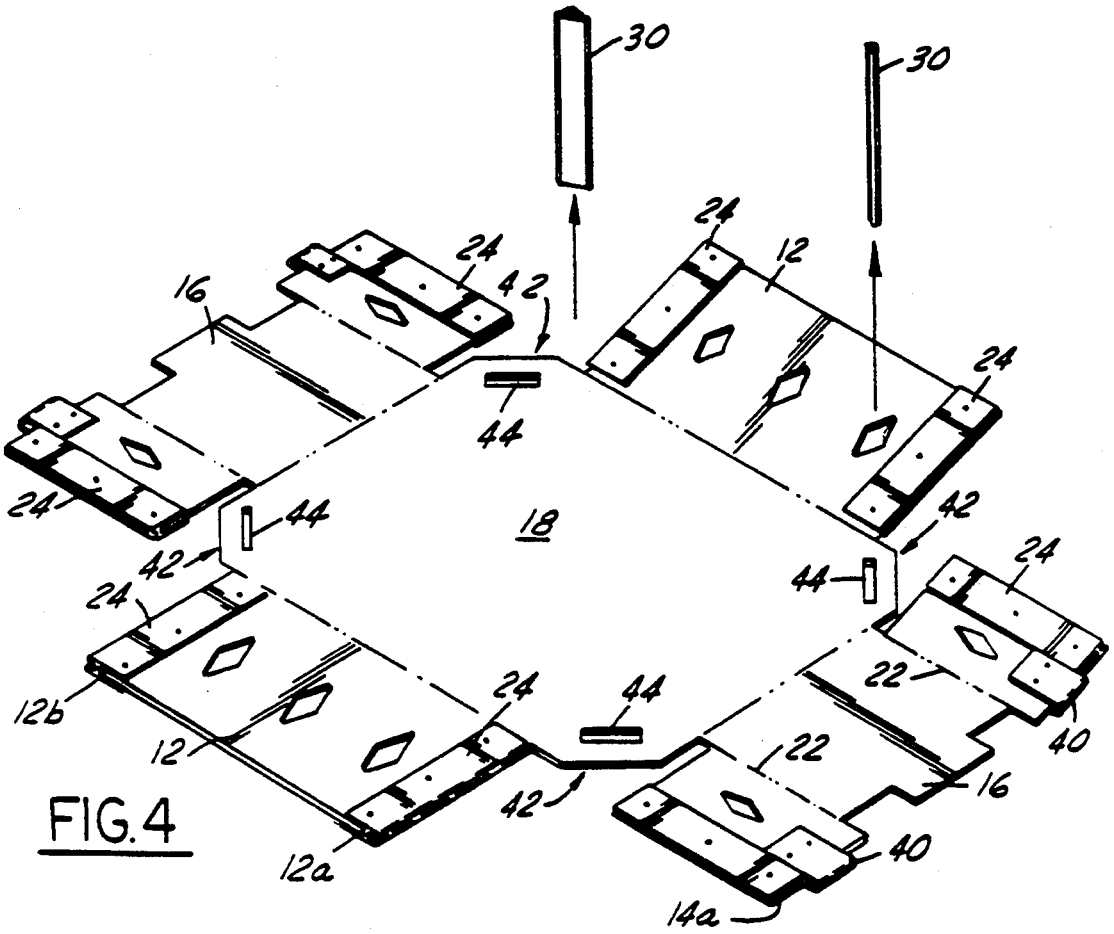
FIG. 4 is a perspective view of a container having a knock down corner construction in accordance with the present invention, with all of the sides of the container collapsed.

The walls 12, 14 and 16 may be collapsed into the plane of the floor 18, as shown in FIG. 4. Walls 12 extend between two wall edges 12*a* and 12*b*. When assembled into a box construction, walls 12, 14 and 16 extend orthogonally to the plane of floor 18. A hock down or collapsible corner or corner construction 20, in accordance with the present invention, joins pairs of walls together. In the bin 10 used in the example of FIG. 1, which is only one example of the various types of collapsible containers available for use with the present invention, walls 14 are flapped extensions of wall 16. A fold line 22, along with the folded flaps, structure two walls 14 flanking the wall 16. Thus, each wall 14 extends between a wall edge 14*a* and a fold line 22.

Figure 2:
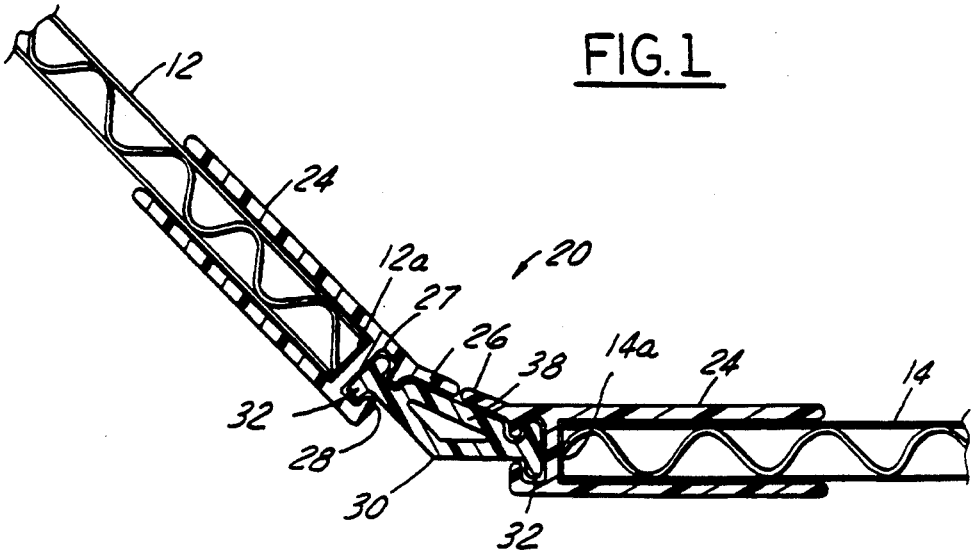
FIG. 2 is an enlarged fragmentary section showing the knock down corner construction of the present invention and taken along line 2—2 of FIG. 1.
Figure 3:
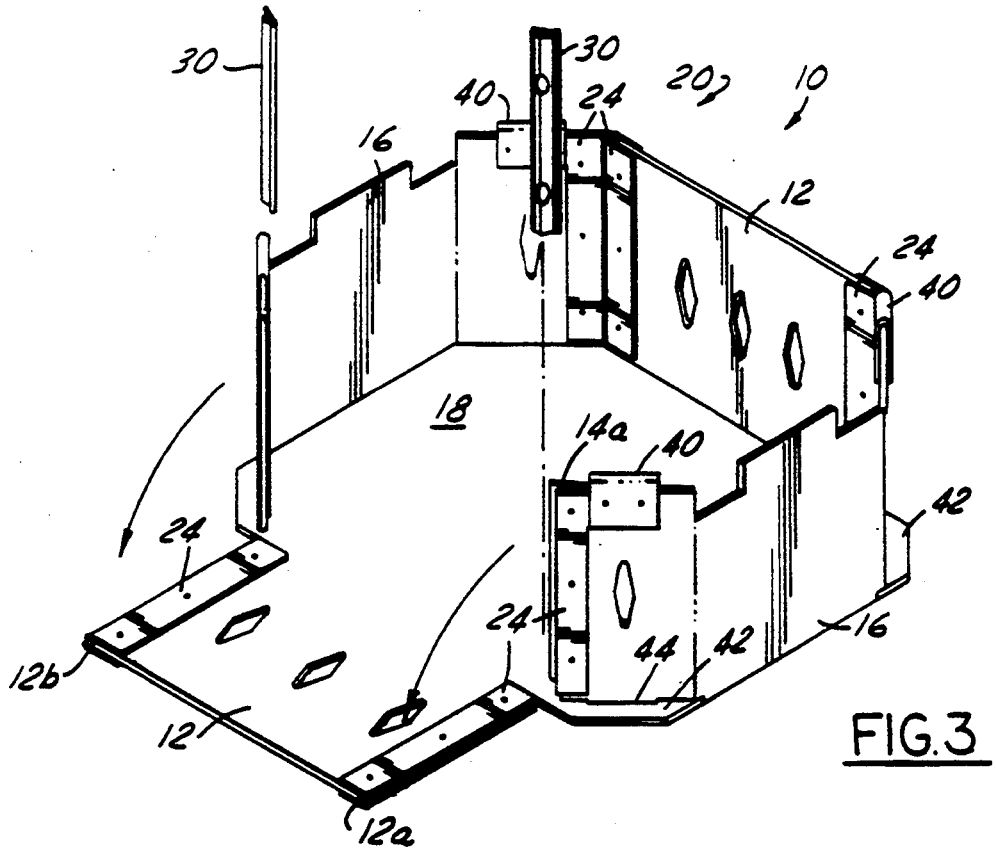
FIG. 3 is a perspective view of a container illustrating the knock down corner construction of the present invention, with one side of the container being collapsed.

Referring now in particular to FIG. 2, the collapsible corner or corner construction 20 of the present invention includes a pair of casement frames, casements, or edge moldings 24 which may be positioned onto an edge of a wall, for example edge 12*a* of wall 12 of the shipping bin 10. Each casement 24 has an inboard lip extension 26 which projects from the casement 24 on one side thereof. Each casement 24 also has a buttressing portion 27 carrying a T-slot 28. The buttressing portion 27 projects outwardly from the casement 24, away from the edge 12*a* of wall 12. Accordingly, the casement 24 and the buttressing portion operate as an extension of the edge of a wall 12. As seen in FIG. 2, another casement 24 is positioned on the edge 14*a* of wall 14.

The corner construction 20 also has an angle section or anchor pin 30 which has a generally triangular cross-section. At two opposing corners thereof are T-sections 32. T-sections 32 are receivable in the T-slots 28 of the casements 24. The T-sections 32 of the angle section 30 are receivable in the T-slots 28 of the casements 24 from an upper end 34 of the comer construction 20, the upper end being defined by the normal orientation of the bin 10 with its side walls projecting orthogonally from the floor 18.

An anchor pin 30 positioned accordingly may be slid down until it rests generally at floor 18. Two holes, as seen in FIG. 1, provide a means of gripping angle sections or anchor pins 30 by a hook, or screwdriver, or specially fashioned tool to slide the anchor pin 30 upwardly and outwardly from the casements 24. Assuming wall 12 is joined to a wall 14 at its opposite edge 12*b* by a collapsible comer construction 20, and anchor pin 30 of the latter corner 20 is also removed, wall 12 is collapsible as it is no longer joined to another wall. Wall 12 is, however, joined to floor 18 and, as a consequence, hingedly swings into the plane of floor 18. Lip extensions 26 provide structural rigidity against a back wall 38 of angle section 30.

Figure 5:
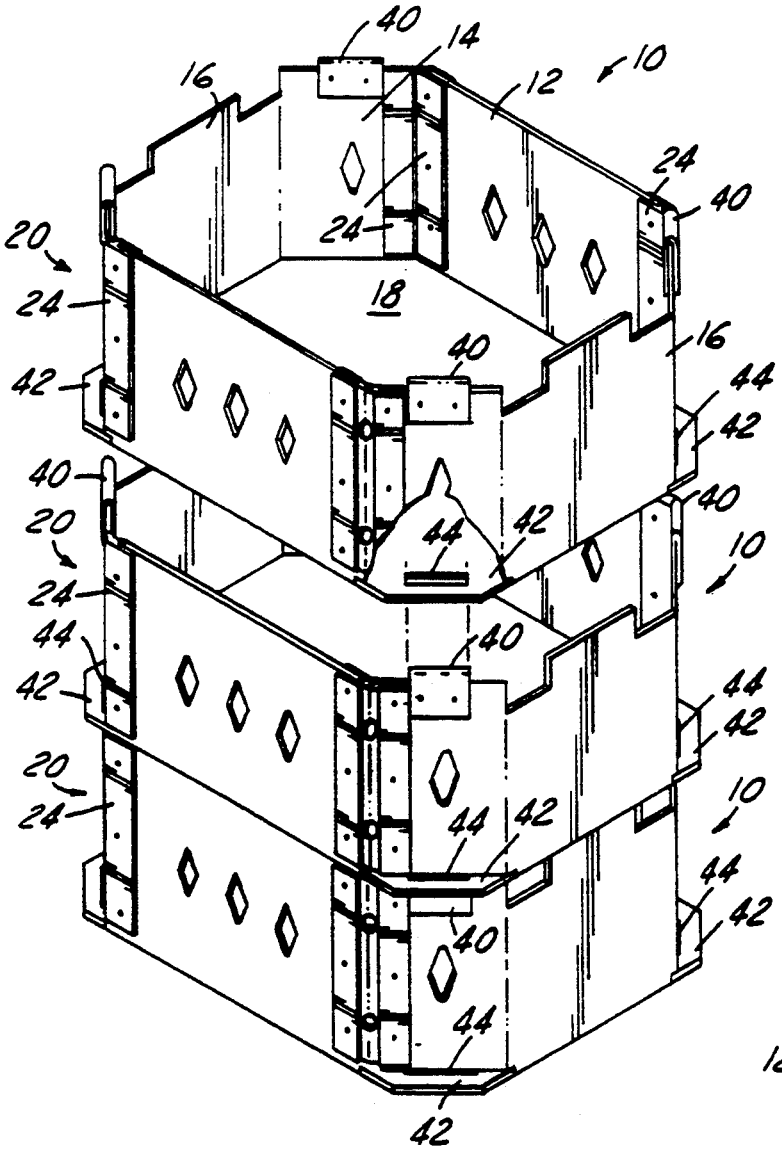
FIG. 5 is a perspective view of several containers stacked one upon the other, all of which have the knock down or collapsible corner construction in accordance with the present invention.

Stacking anchor tabs 40 are preferably placed on the upper edges of walls 14 of bin 10. Tabs 40 provide for a means of interlocking bins 10 when bins 10 are stacked one bin 10 upon the other. Anchor tabs 42, which are but extensions of floor 18, are provided with anchor slots 44 for receiving the tabs 40. As can be seen in FIG. 5, several bins 10 may be stacked one upon the other, each anchored to the other by having each anchor tab 42 received by the anchor slot 44 of a bin stacked upon it.

Figure 6:
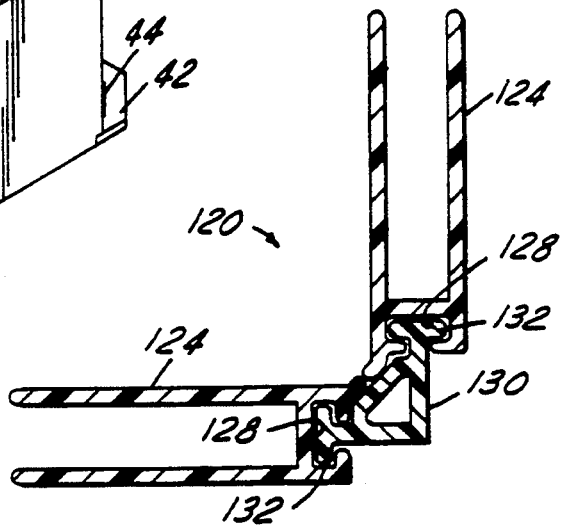
FIG. 6 is a detailed section of another embodiment of the knock down or collapsible corner construction in accordance with the present invention.

The shape of the shipping container shown in FIG. 4 is but one type of shipping container or bin 10 available for the construction of the present invention. Other sections may be seen in FIGS. 6 and 7. With regard to FIG. 6, the anchor pin 130 is formed to provide a right angle relationship between adjoining casements 124 and thereby the walls of a shipping container. The collapsible comer construction 120 also has an angle section or anchor pin 130 of generally a triangular cross-section. At two opposing comers of the anchor pin 30 are T-sections 132 which are disposed orthogonally to one another. These T-sections 132 are receivable in the T-slots 128 of the casements 124.

Figure 7:
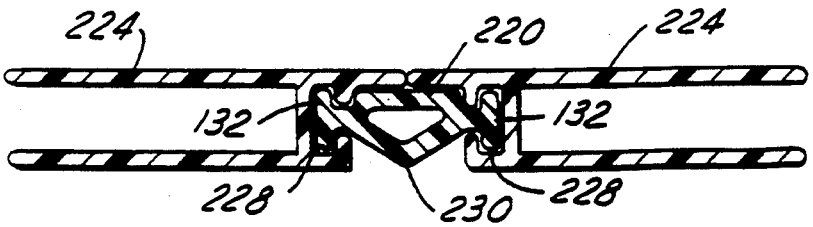
FIG. 7 is a detailed section of yet another embodiment of a knock down or collapsible corner construction in accordance with the present invention.

With regard to FIG. 7, a collapsible corner construction is provided for adjoining casements extending one long wall that may be collapsed in sections. Accordingly, the casements 224 are aligned with one another. The knock down corner or corner construction 220 has an anchor pin 230 from which T-sections 232 extend in an axial disposition with respect to one another. These T-sections 232 are receivable in the T-slots 228 of the casements or frame members 224.

The corner anchor pins are preferably formed from extruded plastic material but may also be made from a rigid material such as steel.

It should be understood that the embodiment of the invention that has been described in detail may be subjected to modifications and other embodiments incorporating the inventive features are contemplated. Accordingly, it is intended that the foregoing disclosure is to be considered as illustrating the principals of the present invention as an example of those features and not as a delimiting description, which is the purpose of the claims that follow.

We claim:

1. A collapsible bin comprising:

a plurality of side walls having upper edges, at least one of said side walls having a first left side edge, a first left side wall portion adjacent said first left side edge, a first right side edge, and a first right side wall portion adjacent said first right side edge, said first left and right side edges being separable from said other side walls, at least one other of said side walls having a second right side edge and a second right side wall portion adjacent said second right side edge, and at least another of said side walls having a second left side edge and a second left side wall portion adjacent said second left side edge, said first left side edge being adjacent said second right side edge and said first right side edge being adjacent said second left side edge;

a floor hingedly attached to said side walls, said side walls being generally orthogonal to said floor and at least one of said side walls being collapsible into the plane of said floor; and a pair of collapsible corner constructions joining said at least one of said side walls to said at least one other of said side walls and said at least another of said side walls, each of said collapsible corner constructions including a casement section for sandwiching one of said edges and said wall portions, each casement section having a T-slot along an edge of said casement and a lip extending from said edge of said casement, and an anchor pin having a pair of T-sections, said T-sections being slidably received in the T-slots of said pair of casements to join said casements and said walls sandwiched therein in a configuration shaping the bin.

2. The collapsible bin of claim 1, wherein said anchor pin being slidable upwardly away from said floor of the bin and outwardly from said T-slots to release said at least one of said side walls so that said at least one of said side walls can collapse into the plane of said floor.

3. The collapsible bin of claim 2, wherein said anchor pin has gripping means for gripping said anchor pin to slide it upwardly from said floor.

4. The collapsible bin of claim 3, wherein said gripping means is at least one hole in said anchor pin for receiving an implement to be gripped for sliding said anchor pin upwardly from said floor.

5. The collapsible bin of claim 1, further comprising a stacking tab disposed on an upper edge of at least one of said side walls and at least one slot in said floor of said collapsible bin, and wherein said collapsible bin is one of a number of collapsible bins having a stacking tab disposed on the upper edge, said collapsible bin being stacked on one of said number of collapsible bins, said at least one slot receiving the stacking tab of said one of said number of collapsible bins.

6. A collapsible bin comprising:

a plurality of side walls having upper edges, at least one of said side walls having a first left side edge, a first left side wall portion adjacent said first left side edge, a first right side edge, and a first right side wall portion adjacent said first right side edge, said first Left and right side edges being separable from said other side walls, at least one other of said side walls having a second right side edge and a second right side wall portion adjacent said second right side edge, and at least another of said side walls having a second left side edge and a second left side wall portion adjacent said second left side edge, said first left side edge being adjacent said second right side edge and said first right side edge being adjacent said second left side edge;

a floor unitary with said side walls, said side walls being bent generally orthogonal to said floor and at least one of said side walls being collapsible into the plane of said floor; and a pair of collapsible corner constructions joining said at least one of said side walls to said at least one other of said side walls and said at least another of said side walls, each of said collapsible corner constructions including a casement section for sandwiching one of said edges and said wall portions, each casement section having a T-slot along an edge of said casement and a lip extending from said edge of said casement, and an anchor pin having a pair of T-sections, said T-sections being slidably received in the T-slots of said pair of casements to join said casements and said walls sandwiched therein in a configuration shaping the bin.

7. The collapsible bin of claim 6, wherein said anchor pins of said pair of collapsible corner constructions are slidable upwardly away from said floor of the bin and outwardly from said T-slots to release said at least one of said side walls so that said at least one of said side walls can collapse into the plane of said floor.

8. The collapsible bin of claim 7, wherein said anchor pins have gripping means for gripping said anchor pin to slide it upwardly from said floor.

9. The collapsible bin of claim 8, wherein said gripping means is at least one hole in each of said anchor pins for receiving an implement to be gripped for sliding said anchor pin upwardly from said floor.

10. The collapsible bin of claim 6, further comprising a stacking tab disposed on an upper edge of at least one of said side walls and at least one slot in said floor of said collapsible bin, and wherein said collapsible bin is one of a number of collapsible bins having a stacking tab disposed on the upper edge, said collapsible bin being stacked on one of said number of collapsible bins, said at least one slot receiving the stacking tab of said one of said number of collapsible bins.

11. The collapsible bin of claim 7, wherein said collapsible corner constructions are disposed between all side walls so that all side walls can collapse into said plane of said floor when all of said anchor pins are slid from said T-slots.

* * * * *